US006978102B2

(12) United States Patent
Okamura et al.

(10) Patent No.: US 6,978,102 B2
(45) Date of Patent: Dec. 20, 2005

(54) EJECTION APPARATUS AND METHOD

(75) Inventors: Mike H. Okamura, Boise, ID (US); Michael B. Lloyd, Meridian, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 89 days.

(21) Appl. No.: 10/613,205

(22) Filed: Jul. 3, 2003

(65) Prior Publication Data

US 2005/0002685 A1 Jan. 6, 2005

(51) Int. Cl.[7] ..... G03G 15/08

(52) U.S. Cl. ..... 399/110; 312/330.1; 399/81; 399/87; 399/111; 399/112; 399/119; 399/126; 399/262; 399/405

(58) Field of Search ..... 399/110, 111, 112, 399/119, 126, 393, 391, 405, 81, 87, 262; 222/165; 347/138, 152

(56) References Cited

U.S. PATENT DOCUMENTS 4,441,129 A 4/1984 Nakao
4,527,209 A 7/1985 Martinez
4,611,256 A 9/1986 Tsujimura
4,623,945 A 11/1986 Deutsch et al.
4,739,424 A 4/1988 Yamada et al.
5,132,732 A * 7/1992 Kalyandurg et al. ..... 399/119
5,396,382 A 3/1995 Murayama
5,402,212 A * 3/1995 Ito et al. ..... 399/111
5,793,565 A 8/1998 Suzuki
6,560,062 B1 5/2003 Kovacs
6,563,667 B1 5/2003 Hamabe et al.

FOREIGN PATENT DOCUMENTS

JP 08152774 * 6/1996 ..... G03G 15/08

* cited by examiner

*Primary Examiner*—Arthur T. Grimley
*Assistant Examiner*—Peter Lee

(57) ABSTRACT

Various embodiments of an ejection apparatus and methods are provided. In one representative embodiment an ejection apparatus includes a bar movable along a first axis and a carriage movable along a second axis which is distinct from the first axis. The bar which has an edge oriented along an angular position between the first axis and the second axis, is in physical communication with the carriage such that movement of the bar along the first axis causes movement of the carriage along the second axis.

16 Claims, 5 Drawing Sheets

EJECTION APPARATUS AND METHOD

BACKGROUND

In well-known image forming devices such as copiers, printers and facsimiles, to name a few, various equipment design configurations exist in order to provide flexibility for the user. For example, an image forming device can be a table-top unit that has integrated functions and which can be accessible to the user on multiple sides of the equipment. In a table-top image forming device, areas of paper storage, paper output trays and toner cartridges can typically be accessed on at least two sides of the equipment, such as the front and back of the device. By contrast, an image forming device can be part of a system that is quite large and free-standing, having modular devices such as a finishing device or output bins attached to one side or both sides of the image forming device. Such modular systems are typically constructed and arranged in a work environment in which user access can be limited to only the front side where an operator panel for user service is located.

In a modular system, the large surface area that may be needed to access to several compartments of the image forming device such as the toner cartridges, the paper storage, the paper path, and others, may require that certain compartments be accessed on at least two sides of the equipment. This in turn may require available space surrounding the equipment for user access. For example, replacement of depleted toner cartridges may require that the user stand squarely in front of the cartridges and use two hands to remove and replace them. Such an arrangement can present difficulties if access to the toner cartridges is on a side of the image forming device other than the front side, and if there are obstructions in the area surrounding it. It would therefore be desirable if more than one side of the image forming device could be used for the placement of functional components even where obstructions in the surrounding areas can limit user access.

BRIEF DESCRIPTION OF THE SEVERAL VIEWS OF THE DRAWINGS

The example embodiments of the present invention can be understood with reference to the following drawings. The components in the drawings are not necessarily to scale. Also, in the drawings, like reference numerals designate corresponding parts throughout the several views.

DETAILED DESCRIPTION

Figure 1:
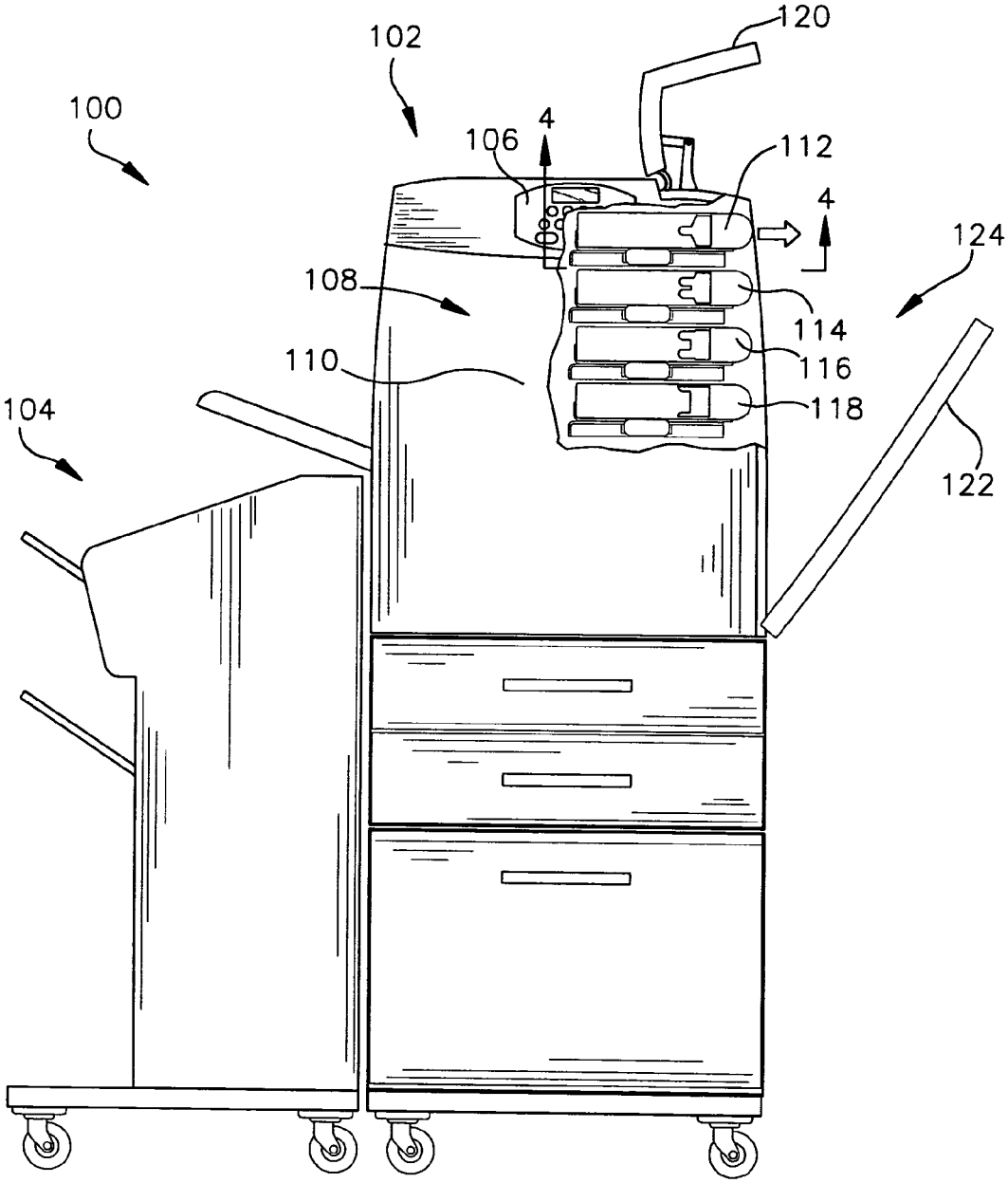
FIG. 1 is a front elevation view of an image-forming device having an ejection apparatus according to an embodiment of the invention.

For convenience, an ejection apparatus in accordance with example embodiments of the present invention is described with respect to an ejection apparatus within the environment of an image forming device, however, one skilled in the art can appreciate that embodiments of the ejection apparatus of the present invention could be used in other devices. FIG. 1 illustrates a modular printing system 100 that includes an image forming device 102 and output device 104. The image forming device 102 has an operator panel 106 along a front side 108 of housing 110 for operating a variety of equipment functions. The front side 108 having an operator panel 106, for example, is a service side of the modular printing system 100 where much, if not all, of the user interface and control over the modular printing system 100 takes place. The operator panel 106 may include, for example, push buttons an other input and display devices that can be used for configuration of the operation of the image forming device 102. For example, the operator panel 106 may facilitate specification of the size of print media, the type of finishing operation, and other operational parameters, etc. In one embodiment, the system 100 is a laser printer, such as, for example, a color laser printer having different toner stored in separate cartridges. The cut out of housing 110 reveals toner cartridges 112, 114, 116, and 118 each of which contains a toner of one of a variety of colors, for example, black, cyan, magenta and yellow, although other colors could be used. The toner cartridges are accessible to the user for replacement upon opening side panels 120 and 122 along a second side 124 of the image forming device.

Figure 2:
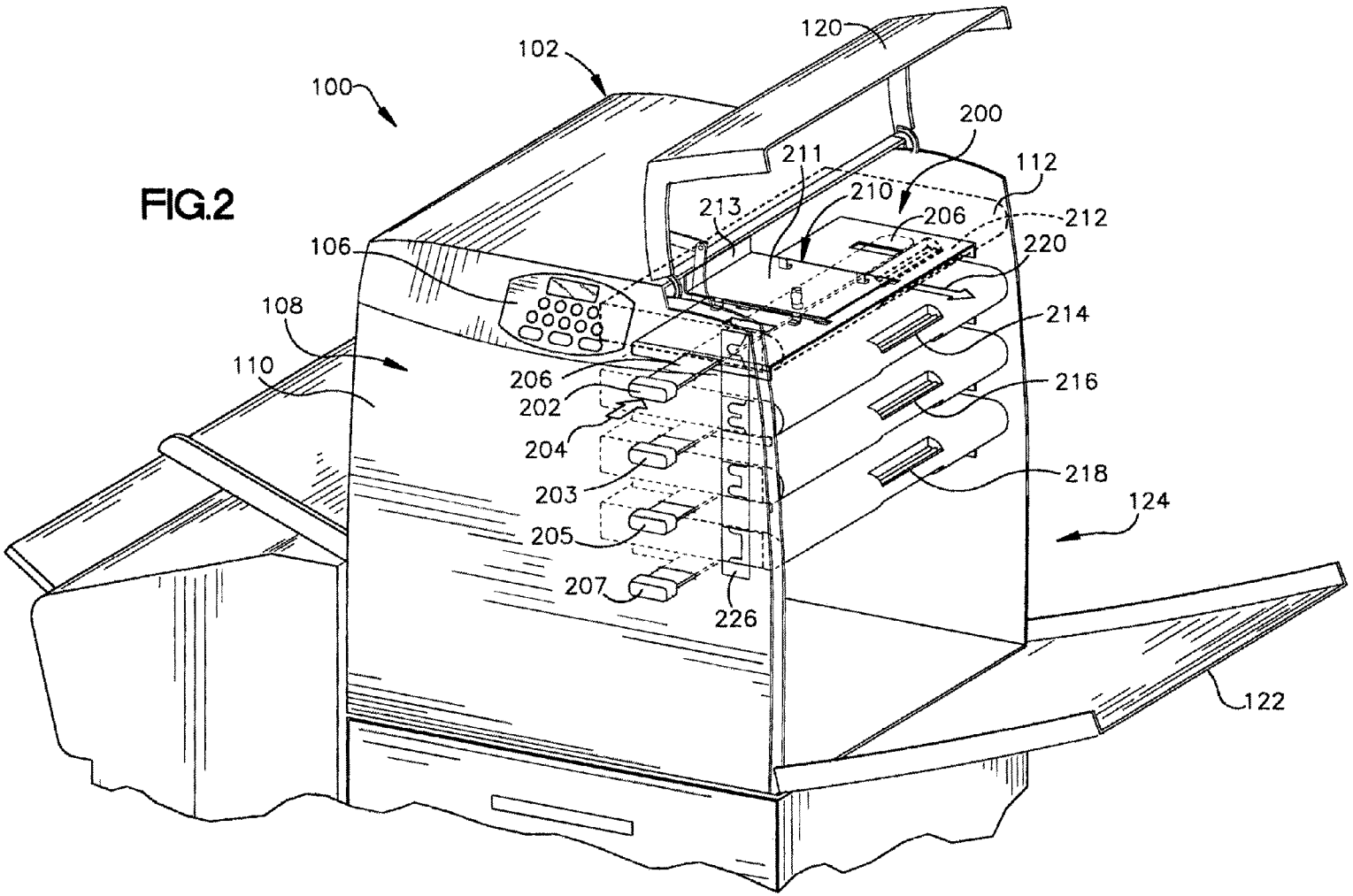
FIG. 2 is a partial perspective view of an image forming device of FIG. 1 illustrating an inside storage of toner cartridges that can be ejected from an ejection apparatus according to an embodiment of the invention.

FIG. 2 illustrates a partial perspective view of image forming device 102 which includes ejection apparatus 200 according to an embodiment of the invention. Ejection apparatus 200 can be used, for example, to eject toner cartridge 112 (shown in phantom) from its nesting position inside the image forming device. Ejection apparatus 200 can be activated by button 202 along the same front side 108 of the image forming device 102 having operator panel 106. Activation of the ejection apparatus 200 occurs when force is applied to button 202 along a first axis as indicated by arrow 204. Carriage 210 which supports toner cartridge 112 is movable along a second axis as indicated by arrow 220. The angle of second axis 220 relative to the first axis 204 is shown as 90 degrees. However, the angle between the first axis 204 and second axis 220 may be less than or greater than about 90 degrees, to the extent practicable. Image forming device 102 can also be equipped with an ejection apparatus for each of the toner cartridges 114, 116 and 118 and activated by buttons 203, 205, and 207. Buttons 202, 203, 205, and 207 are shown located along front side 108 of housing 110 and separate from that of the operator panel 106, but the buttons can also be incorporated into the operator panel 106 in other embodiments.

Carriage 210 is shown having a support base 211 for mounting toner cartridge 112. The carriage can include wall 213 which extends upward from support base 211 and provides resistance against the toner cartridge 112 or other replaceable component to be ejected when carriage 210 moves along the second axis during ejection. For example, when carriage 210 is used to eject toner cartridge 112 inside image forming device 102, wall 213 prevents slip of the toner cartridge 212 with respect to support base 211 when the carriage moves in an outward direction toward the second side 124 of the image forming device. In addition, wall 213 can provide the user assurance that the replaceable component to be ejected is properly aligned and registered on the carriage when it is replaced after ejection.

Button 202 is in physical communication with bar 206 and the bar engages carriage 210 as will be described in detail below. Bar 206 has a rectangular cross-section, however, any cross-section could be used, including but not limited to, a round, square, and triangular cross-section, for example. When button 202 is activated, movement of bar 206 along the first axis causes a movement of carriage 210 along the second axis as indicated by arrow 220. With respect to the image forming device of FIG. 2, ejection apparatus 200 can be activated on a first side 108 of image forming device 102 to move carriage 210 and toner cartridge 112 in an outward direction relative to the second side 124 of the image forming device. As shown, the ejection apparatus 200 is capable of ejecting the toner cartridge 112 outward from the second side 124 of modular printing system 100 which is substantially orthogonal to the front side 108. In some embodiments, however, the ejection apparatus 200 can eject a toner cartridge 112 along a second axis 220 such that the angle between the first axis 204 and the second axis 220 may be from an angle greater than zero to about 180 degrees, to the extent practicable. Once the toner cartridge is released from its nesting position in the image forming device, it is possible for the user to remain standing along the front side while removing the toner cartridge from the second side of the image forming device. FIG. 2 shows toner cartridges 112, 114, 116 and 118 having handles 212, 214, 216, and 218, respectively, centered along the edge of the toner cartridges for possible removal by the user with one hand. Example embodiments which employ electrical components and apparatuses may be used in addition to the mechanical embodiments described above. For example, the button 202 which is located on the front side 108 of the image forming device 102 can be actuated by an electrical device, such as a motor or a solenoid, which can move the carriage 210 toward a second side 124 of the image forming device 102.

Figure 3:
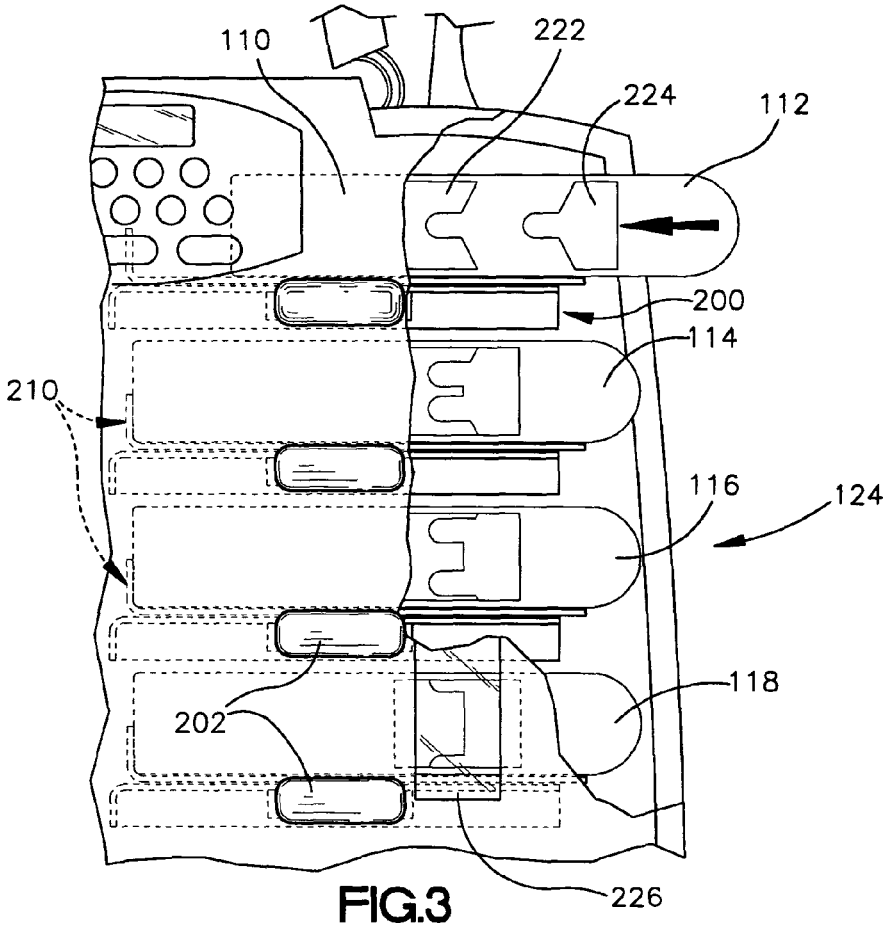
FIG. 3 is a front elevation view of a break out section of an image forming device of FIG. 2 according to an embodiment of the invention.

FIG. 3 is a front elevation break out illustration of image forming device 102 of FIG. 2 according to an embodiment of the invention. FIG. 3 shows toner cartridge 112 in an ejected position and toner cartridges 114, 116, and 118 in their nesting positions. Ejection apparatus 200 can be associated with a keying feature to indicate whether the toner cartridge is in the nesting position. For example, ejection apparatus 200 is shown associated with a first portion 222 of a key design and toner cartridge 112 provides a matching or mating second portion 224 of key design. The first portion 222 of the key design can be mounted to an internal structure (not shown) secured to the inside of the housing 110 of the image forming device, for example. The first portion 222 and the second portion 224 of the key design can each be a plastic molded piece that are mounted via a screw, a latch, a snap-fit, glue, etc., to the internal structure (not shown) and the toner cartridge 112, respectively. The portions of the key design, when mated properly, can ensure that a replacement cartridge is properly placed on carriage 210 and that ejection apparatus 200 is ready for successful ejection. The housing 110 along front side 108 can provide an opening or a window 226 so that the user can visually determine if the toner cartridge 112 and the carriage 210 are placed in the proper position. Also, a different keying design can be associated with the ejection apparatus for each toner cartridge, so that the correct toner color will be placed in the correct location in the image forming device.

Figure 4:
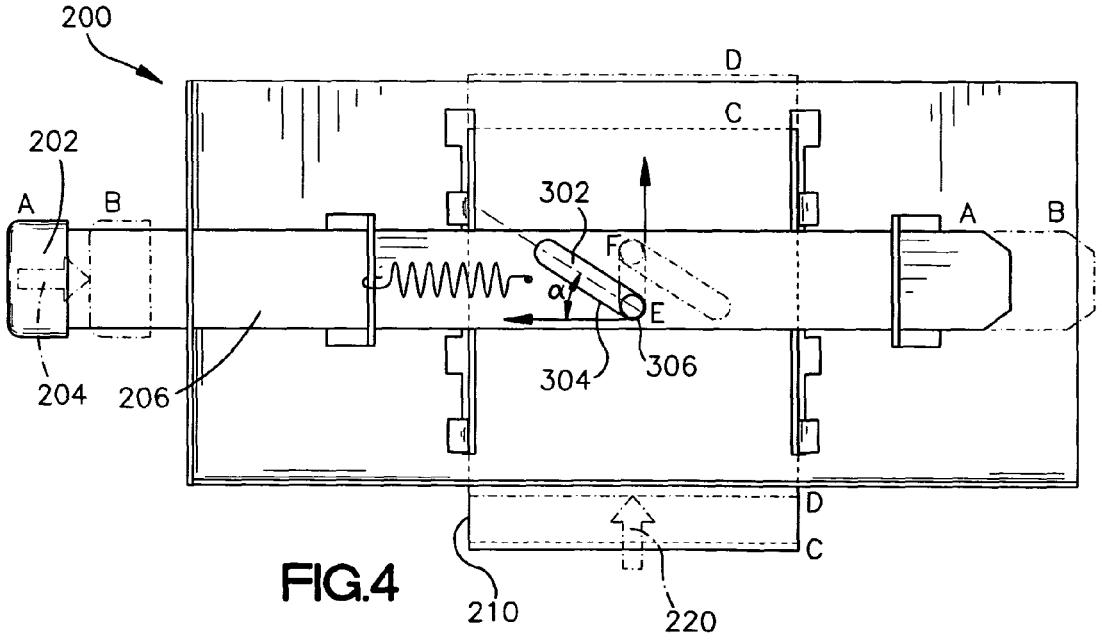
FIG. 4 is a bottom view of the ejection apparatus taken from the lines 4—4 of FIG. 1 according to an embodiment of the invention.

FIG. 4 illustrates ejection apparatus 200 taken along lines 4—4 of FIG. 1 according to an embodiment of the invention. Button 202 can be moved along a first axis, indicated by arrow 204, from a first position A prior to activation to a second position B (shown in phantom) upon activation. The movement of button 202 and bar 206 along the first axis causes movement of carriage 210 along a second axis, indicated by arrow 220, from a first position C prior to activation to a second position D (shown in phantom) upon activation. FIG. 4 shows the first axis being orthogonal to the second axis, however, the ejection apparatus of the present invention could be made such that the angle that separates the movement along the first axis 204 and the second axis 220 can range from an angle greater than zero to about 180 degrees, to the extent practicable. In the environment of an image forming device, for example, an orthogonal arrangement is convenient where button 202 can be activated along the front side 108 of the image forming device 102 and toner cartridge 112 can be accessed or ejected from the second side 124 of the image forming device as illustrated in FIG. 1.

With reference to FIG. 4 bar 206 defines an opening 302 having an edge 304 that is oriented along an angular position such that the angle alpha can be any angle between the first axis, arrow 204 and the second axis, arrow 220. In some embodiments, edge 304 can be oriented along an angular position such that the angle alpha is an angle that is near the center of the angle between the first axis 204 and the second axis 220. The angle alpha between the two axes, may determine practical design considerations such as the force required to eject a replaceable object, the displacement of the replaceable object after ejection, as well as other factors that may be optimized. For example, when the angle between the first axis 204 and the second axis 220 is about 90 degrees, the angle alpha can range from about 20 degrees to about 70 degrees, although the angle alpha can be any angle between the first axis 204 and the second axis 220, to the extent practicable. Opening 302 is shown as a slot, but it is to be understood that opening 302 can be an opening of any suitable shape so long as the opening has an edge oriented along an angular position between the first axis and the second axis. Carriage 210 is in physical communication with bar 206 via pin 306 which extends through opening 302. The extension of the pin through the opening creates an interference between the bar 206 and carriage 210 so that movement of the bar along the first axis causes movement of the carriage along the second axis. The force on bar 206 is transferred to pin 306 forcing movement of the pin along the edge 304 of opening 302 from a first position E to a second position F. Movement of the pin and the carriage is stopped if the pin reaches the end of opening 302 at position F (shown in phantom), however, any displacement of pin 306 along edge 304 is possible.

Pin 306 is shown as an integral portion of carriage 210, but the pin can be a separate component physically connected to the carriage. The pin serves as an interference component by which movement of the button 202 and bar 206 cause movement of carriage 210. The force exerted on the button is transferred to the carriage by the pin, through physical contact; however, any interference component or apparatus which transfers movement from the bar 206 to the carriage 210 known by those of ordinary skill in the art, can be used. For example, any protrusion extending from carriage 210 or which is in physical communication with the carriage and contacts bar 206 can be used to ultimately transfer force from the button to the carriage. The interaction of the pin 306 with the edge 304 of opening 302, translates the motion of bar 206 in the direction of the first axis to motion of the carriage 210 in the direction of the second axis. However, one of ordinary skill in the art can appreciate many alternative translation apparatuses that can be used to translate the movement of bar 206 along the first axis to movement of the carriage 210 along the second axis.

The displacement of the carriage 210 can depend upon the component length of edge 304 of opening 302 in bar 202 as measured along the second axis. The force by which carriage 210 moves along the second axis can depend upon the force applied to button 202 and the angular position of edge 304 of opening 302 relative to the first axis and the second axis as can be appreciated by those with ordinary skill in the art. For example, the ejection apparatus can be designed to exert a force on carriage 210 to release toner cartridge 112 from its nesting position so as to facilitate easy removal by a user facing the front side 108 of image forming device 102. FIG. 3 shows toner cartridge 112 ejected from its nesting position with a portion of the cartridge extending beyond the cartridges 114, 116 and 118. This allows the user to easily grab the toner cartridge with one hand, or otherwise reduces the pull force required to fully remove the cartridge from the image forming device. In some embodiments, the ejection force should not be too great so as to eject the toner cartridge a distance beyond its center of gravity, causing it to fall out of carriage 210. The actual force generated can be determined empirically or by calculation as can be appreciated. This force may be dependent upon the force with which the user pushes the button 202, the magnitude of the angle alpha (FIG. 4), as well as other factors. In any event, the ejection apparatus of the present invention can help reduce or eliminate awkwardness in removing toner cartridges which are located along the side of an image forming device whereas the ejection apparatus is actuated along the front side.

Figure 5:
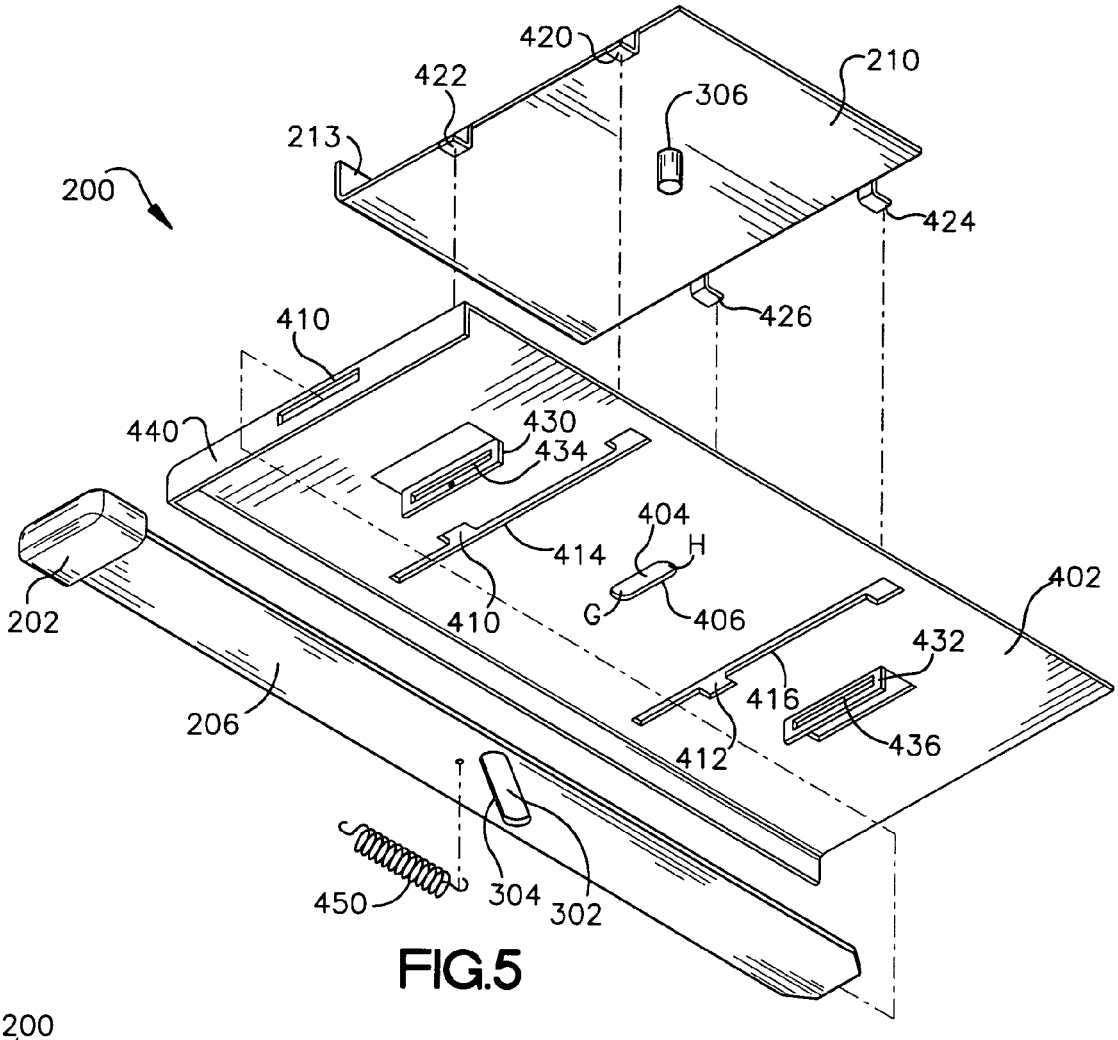
FIG. 5 is an exploded view of the ejection apparatus of FIG. 4 according to an embodiment of the invention.

With reference to FIG. 5, ejection apparatus 200 further includes stationary frame 402 according to another embodiment of the present invention. The term stationary means that the frame does not move relative to the first axis and the second axis during actuation. FIG. 5 is an exploded view illustration of the ejection apparatus 200 of FIG. 4 and illustrates the mechanism by which the movement of carriage 210 can be restricted along the second axis. Stationary frame 402 is shown positioned, along a vertical axis, between carriage 210 and bar 206. Carriage 210 is in physical communication with the stationary frame 402 to restrict a movement of the carriage to the second axis. Stationary frame 402 defines an opening 404 with edge 406 oriented along the second axis. Pin 306 extends through opening 404 to establish interference between the carriage 210 and stationary frame 402. When bar 206 moves along the first axis, the movement of pin 306 caused by edge 304 of opening of the bar, is restricted to the second axis by edge 406 of opening 404 of the stationary frame. Movement of pin 306 from a first position E (FIG. 4) to a second position F (FIG. 4) along edge 304 of opening of bar 302 also causes movement from a first position G (FIG. 5) to a second position H (FIG. 5) along edge 406 of opening 404 of the stationary frame. The engagement of the pin 306 along the edge 304 of opening 302, which is oriented along an angular position between the first axis and the second axis, and the engagement of pin 306 along edge 406 of opening 404, which is oriented along the second axis, translates the motion of bar 206 along the first axis to motion of the carriage 210 along the second axis. However, one of ordinary skill in the art can appreciate many alternative translation apparatuses that can be used to translate the movement of the bar 206 along the first axis to movement of the carriage 210 along the second axis.

The displacement of carriage 210 can depend upon the length of edge 406 of opening 404 of stationary frame 402, in addition to the length of edge 304 of opening 302 in bar 206 along the second axis, as mentioned above. FIG. 3, for example, shows that the length of edge 406 of the stationary frame is equal to the length of edge 304 of the bar along the second axis, and so the displacement of the carriage along the second axis is determined by both.

In another embodiment of the present invention, stationary frame 402 can include a component or an apparatus to prevent rotational movement of carriage 210 about pin 306 when force is applied to bar 206. FIG. 5 illustrates track openings 410 and 412 having edges 414 and 416, respectively, of stationary frame 402. Retainer tabs 420, 422, 424 and 426 extend from carriage 210 and can extend through track openings 410 and 412 to restrict movement of the carriage 210 to the second axis. When bar 206 is moved along the first axis, the interference of pin 306 along edge 304 in opening 302 of the bar moves carriage 210 along the second axis. Although edge 304 of opening 302 of the bar can cause the carriage to move at an angle relative to the first axis and the second axis, the retainer tabs move along edges 414 and 416 of track openings 410 and 412 and restrict movement of the carriage to the second axis. It can be seen that either opening 404 of the stationary frame or the pair of track openings 410 and 412 can alone suffice to restrict movement of the carriage to the second axis, or both may be used as shown in the figures.

In another embodiment of the present invention, ejection apparatus 200 can include an apparatus that restricts the movement of bar 206 to the first axis. The exploded bottom view of FIG. 5 shows stationary frame 402 includes guides 430 and 432. Guides 430 and 432 are shown as integral tabs of the stationary frame 402 extending downward from base 408, and have openings 434 and 436 which the bar passes through when the ejection apparatus is assembled. A guide can be any component that restricts a movement of bar 206 to the first axis. For example, a channel guide can be mounted onto the stationary frame or the image forming device for this purpose, as well as a myriad of other as would be known by one of ordinary skill in the art.

Ejection apparatus can be assembled by placing carriage 210 above stationary frame 402 and placing bar 206 below the stationary frame along a vertical axis. As illustrated in FIG. 5, the bar can be inserted through opening 410 in wall 440 and openings 434 and 436 of guides 430 and 432, respectively of the stationary frame 402. Retainer tabs 420, 422, 424 and 426 of carriage 210 can be fitted through openings 410 and 412 of the stationary frame, and pin 306 can be inserted into opening 404. Stationary frame 402 can have a mounting surface such as wall 440 shown extending downward from base 408. Wall 440 can be mounted to housing 110 of the image forming device 102 (FIGS. 1,2,3) for example, or some other fixture that will ensure that the stationary frame is in a fixed position relative to the first axis and the second axis.

Figure 6:
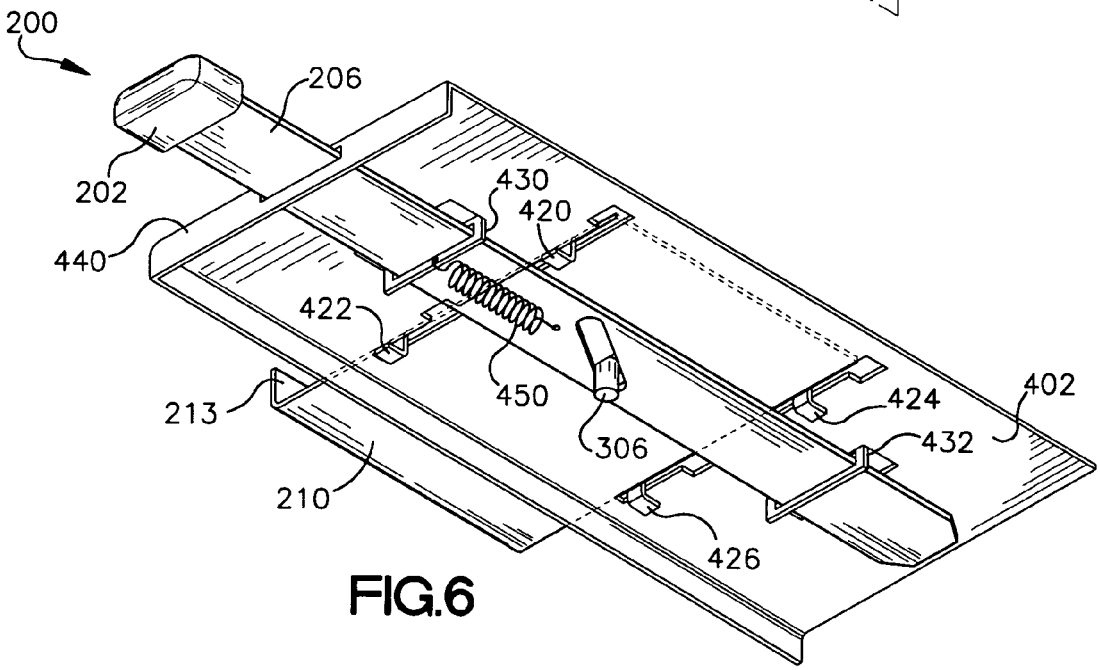
FIG. 6 is bottom perspective view of the ejection apparatus of FIG. 4 according to an embodiment of the invention.

Ejection apparatus can also include a component or apparatus for returning carriage 210 and bar 206 into their retracted positions. Tension spring 450 is shown attachable to bar 206. In FIG. 6 the tension spring is shown attached to guide 430 of stationary frame 402 and to bar 206. The energy stored in tension spring 450 when button 202 is pushed by the user and bar 206 is extended, is released when the force on the button is no longer applied. The release in tension causes bar 206 to be returned to position A (FIG. 4), which forces in turn forces carriage 210 to be returned to position C (FIG. 4).

Figure 7:
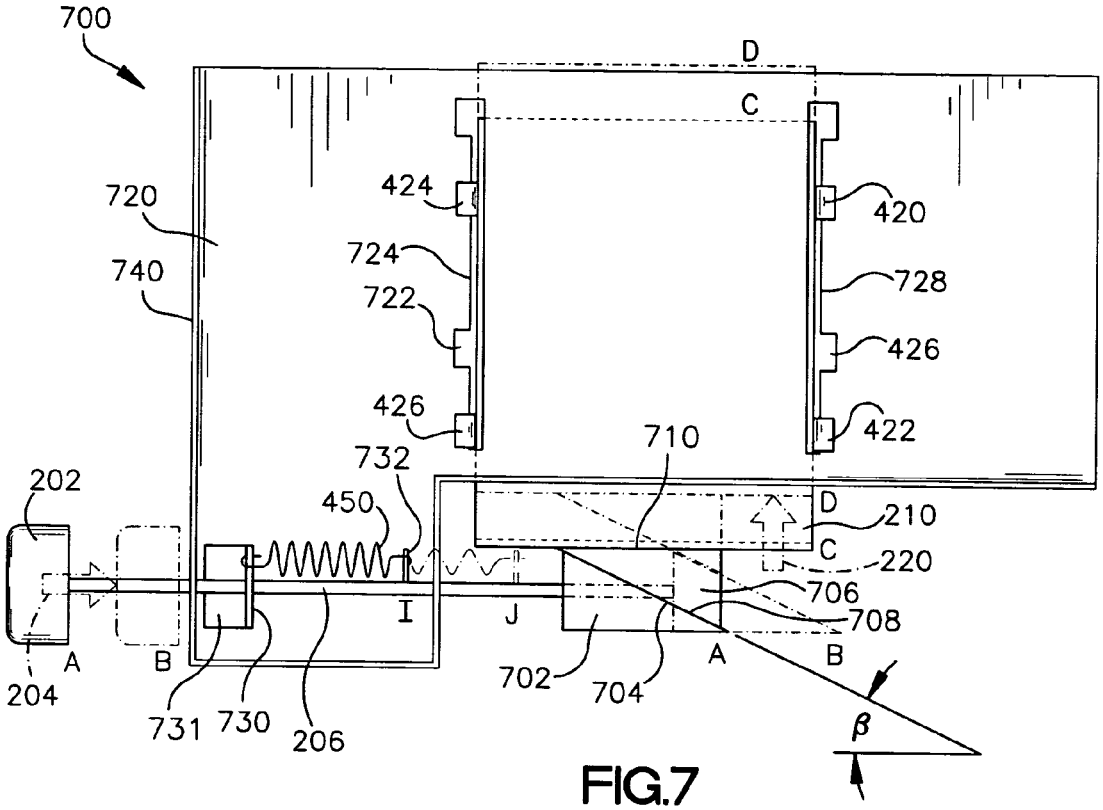
FIG. 7 is a bottom view of the ejection apparatus according to an embodiment of the invention.

FIG. 7 is a bottom view illustration of ejection apparatus 700 according to another embodiment of the present invention. The bar 206 is movable along a first axis, arrow 204, and is in physical communication with a first angled member 702 that has a first edge 704 oriented in an angular position relative to the first axis 204 and the second axis, arrow 220. The carriage 210 is in physical communication with a second angled member 706 having a second edge 708 oriented in an angular position, such that the first angled member 702 and the second angled member 706 contact one another in a mating position along the first edge 704 and the second edge 708. As shown, button 202 can be moved along a first axis 204 from a first position A prior to activation to a second position B (shown in phantom) upon activation. The movement of button 202 and bar 206 along the first axis 204 causes movement of carriage 210 along a second axis 220 from a first position C prior to activation to a second position D (shown in phantom) upon activation. When force is exerted on the button 202 causing movement of the bar 206 along the first axis 204 the first edge 704 of the first angled member 702 slides against the second edge 708 of the second angled member 706 and causes movement of the carriage 210 along the second axis 220. The first angled member 702 which is shown in physical communication with bar 206 and the second angled member 706 which is shown in physical communication with carriage 210 can be integrated features of the bar 206 and the carriage 210, respectively.

Referring to FIG. 7, the first axis 204 is shown as being orthogonal to the second axis 220. In the environment of an image forming device as shown in FIG. 1, for example, an orthogonal arrangement is convenient where button 202 can be activated along the front side 108 of the image forming device 102 and toner cartridge 112 can be accessed or ejected from the second side 124 of the image forming device. However ejection apparatus 700 of FIG. 7 could be made such that the angle that separates the movement along the first axis 204 and the second axis 220 can range from an angle greater than zero to about 180 degrees, to the extent practicable. For example, the carriage 210 and outward edge 710 of the second angled member 706 can be made to contact one another along a different axis than the contact orientation shown in FIG. 7 in order to translate movement of the carriage along a second axis 220 that is less than or greater than about 90 degrees from the first axis 204.

Regardless of the angle between the first axis 204 and the second axis 220, the first edge 704 of first angled member 702 and the second edge 708 of second angled member 706 which slide against one another, can be oriented along an angular position such that the angle, beta, can be any angle between the first axis 204 and the second axis 220. However, other practical design considerations such as the force required to eject a replaceable object, the displacement of the replaceable object after ejection, as well as other factors, may be optimized for example, if the angle beta is closer to the center of the angle that separates the first axis 204 from the second axis 220. For example, when the angle between the first axis 204 and the second axis 220 is about 90 degrees, the angle beta can range from about 20 degrees to about 70 degrees, even though the angle alpha can be any angle between the first axis 204 and the second axis 220, to the extent practicable. The force by which carriage 210 moves along the second axis 220 can depend upon the force applied to button 202, the magnitude of the angle beta, as well as other factors as can be appreciated by those of ordinary skill in the art.

Ejection apparatus 700 can further include stationary frame 720 to restrict movement of carriage 210 to the second axis 220, according to another embodiment of the present invention. FIG. 7 show retainer tabs 420, 422, 424 and 426 of carriage 210 extend through track openings 722 and 726 of frame 720 to restrict movement of the carriage 210 to the second axis, arrow 220. The retainer tabs 420, 422, 424, and 426 move along edges 724 and 728 of track openings 722 and 726 to restrict movement of the carriage 210 to the second axis, arrow 220, when first edge 704 of first angled member 702 slides against second edge 708 of second angled member 706.

Ejection apparatus 700 can further include a component or apparatus that restricts the movement of bar 206 to the first axis 204 when button 202 is pushed. For example, stationary frame 720 can include guide 730 which extends downward from opening 731 of the stationary frame 720. Bar 206 can be inserted through an opening (not shown) in wall 740 of stationary frame 720 and also through an opening (not shown) of guide 730, so that the movement of the bar 206 is restricted to the first axis 204. An over-travel stop for limiting the displacement of the bar 206 and the first angled member 702 is provided by button 202 when it comes into contact with the wall 740 of the stationary frame 720.

FIG. 7 also illustrates, according to another embodiment, tension spring 450 which is shown attached to bar 206 on one end and to peg 732 on the other end. Tension spring 450 allows return of the bar 206 and carriage 210 to the original positions after ejection of a replaceable component, for example, a toner cartridge. Energy is stored in tension spring 450 in its extended position J (shown in phantom) when button 202 is pushed by the user and bar 206 is extended to position B (shown in phantom) and carriage 210 is moved to position D (shown in phantom). The stored energy is released when the force on the button is no longer applied, and the release in tension causes bar 206 to be returned to position A.

In another embodiment (not shown), the ejection apparatus can alternatively comprise a rotating linkage mechanism by which movement of a slider link along a first axis causes a rotating link to rotate and move the carriage along a second axis. Thus, when the slider link is activated, at least one rotating link coupled to the slider link is displaced, thereby advancing the carriage and a replaceable component, for example, a toner cartridge.

Although the invention is shown and described with respect to certain embodiments, it is obvious that equivalents will occur to others skilled in the art upon the reading and understanding of the specification. While mechanical solutions are described in detail, electrical solutions may also be employed. For example, with respect to FIG. 2, the button 202 on the front side 108 of the image forming device 102 may actuate a solenoid or motor which advances the carriage 210, and thus the cartridge 112, toward and out the second side 124 of the image forming device. The present invention includes all such equivalents and modification, and is limited only by the scope of the claims.

What is claimed is:

1. An image forming device, comprising:

an ejection apparatus comprising;

a button, the button being accessible to a first side of the image forming device;

a bar movable along a first axis;

a carriage in physical communication with the bar and is movable along a second axis which is distinct from the first axis;

wherein movement of the bar along the first axis causes movement of the carriage along the second axis; and wherein the ejection apparatus is capable of ejecting a replaceable component outward from a second side of the image forming device when the button is actuated, the first side of the image forming device being distinct from the second side of the image forming device.

2. The image forming device of claim 1, wherein the operator panel is disposed on the first side of the image forming device.

3. The image forming device of claim 1, wherein the replaceable component comprises a toner cartridge.

4. The image forming device of claim 1, wherein the first side of the image forming device is substantially orthogonal to the second side of the image forming device.

5. The image forming device of claim 1, wherein the first axis is substantially perpendicular to the first side of the image forming device and the second axis is substantially perpendicular to the second side of the image forming device.

6. The image forming device of claim 1, wherein the angle between the first axis and the second axis is about 90 degrees.

7. The image forming device of claim 1, wherein:

the bar defines an edge oriented along an angular position between the first axis and the second axis; and the carriage is in physical communication with the edge of the bar.

8. The image forming device of claim 7, wherein:

the edge oriented along an angular position between the first axis and the second axis is along an opening of the bar;

the carriage is in physical communication with a pin that extends from the carriage and through the opening of the bar; and movement of the bar along the first axis causes movement of the carriage from a first position along the edge of the opening of the bar to a second position along the edge of the opening of the bar.

9. The image forming device of claim 7 wherein:

the edge of the bar that is oriented along angular position between the first axis and the second axis is a first edge of a first angled member in physical communication with the bar;

the carriage is in physical communication with a second edge of a second angled member, the second edge being oriented along angular position between the first axis and the second axis; and the first edge of the first angled member is in contact with of the second edge of the second angled member such that movement of the bar along the first axis causes movement of the carriage along the second axis.

10. The image forming device of claim 8, further comprising:

a stationary frame; and at least a portion of the carriage is in physical communication with the stationary frame and the stationary frame restricts a movement of the carriage to the second axis.

11. A method of ejecting a replaceable component from an image forming device, the method comprising:

pushing a button disposed along a first side of the image forming device to move a bar along a first axis;

engaging the bar with a carriage, supporting the replaceable component, to move the carriage outward from a second side of the image forming device; and wherein the first side of the image forming device is distinct from the second side of the image forming device.

12. The method of claim 11, wherein the carriage is moved in a direction substantially orthogonal to the first side.

13. The method of claim 12, further comprising contacting a pin, in physical communication with the carriage, with an edge of an opening in the bar that is oriented in an axis between the first and the second axis.

14. The method of claim 13, further comprising:

constraining the movement of the bar along the first axis; and constraining the movement of the carriage along the second axis.

15. The method of claim 14, further comprising contacting a pin, in physical communication with the carriage, with an edge of an opening in the frame that is oriented along the second axis.

16. A method of ejecting a replaceable component from an image forming device, the method comprising:

pushing a button disposed along a first side of the image forming device;

moving a bar along a first axis by pushing the button;

moving a carriage, supporting the replaceable component, outward from a second side of the image forming device along a second axis by sliding a first angled edge of the bar along a second angled edge of the carriage; and wherein the first side of the image forming device is distinct from the second side of the image forming device.

* * * * *

UNITED STATES PATENT AND TRADEMARK OFFICE

CERTIFICATE OF CORRECTION

PATENT NO. : 6,978,102 B2
APPLICATION NO. : 10/613205
DATED : December 20, 2005
INVENTOR(S) : Mike H. Okamura et al.

It is certified that error appears in the above-identified patent and that said Letters Patent is hereby corrected as shown below:

On the title page, item (73), in "Assignee", in column 1, line 2, delete "LP.," and insert -- L.P., --, therefor.

In column 9, line 41, in Claim 9, after "along" insert -- an --.

In column 9, line 50, in Claim 9, delete "of" before "the second edge".

Signed and Sealed this

Sixth Day of October, 2009

David J. Kappos

David J. Kappos
*Director of the United States Patent and Trademark Office*